United States Patent [19]

Sumitomo et al.

[11] 4,069,566

[45] Jan. 24, 1978

[54] TAKE-UP METHOD OF CONTINUOUS FILAMENT BUNDLES OF SYNTHETIC FIBERS AND APPARATUS THEREFOR

[75] Inventors: Norio Sumitomo; Yoshiki Matsumoto, both of Iwakuni, Japan

[73] Assignee: Toyobo Co., Ltd., Osaka, Japan

[21] Appl. No.: 666,269

[22] Filed: Mar. 12, 1976

[30] Foreign Application Priority Data

Mar. 12, 1975 Japan ..... 50-30473

[51] Int. Cl.[2] ..... B65H 54/80

[52] U.S. Cl. ..... 28/289; 226/97

[58] Field of Search ..... 28/21; 19/159 R; 226/97; 53/3, 198

[56] References Cited

U.S. PATENT DOCUMENTS

| | | | |
|---|---|---|---|
| 2,971,683 | 2/1961 | Paulsen | 226/97 |
| 3,141,201 | 7/1964 | Gasser | 19/159 R |
| 3,234,627 | 2/1966 | Russo et al. | 28/21 |
| 3,706,407 | 12/1972 | King | 226/97 |

*Primary Examiner*—Louis K. Rimrodt

*Attorney, Agent, or Firm*—Birch, Stewart, Kolasch and Birch

[57] ABSTRACT

Method for the take-up of continuous filament bundles of synthetic fibers at a high speed, which comprises introducing the continuous filament bundles discharged from an air jetting device and carried on the air stream into a bent tube provided downstream from the air jetting device, which is rotating in substantially reverse direction to that of the continuous filament bundles discharged from the outlet of the bent tube at a peripheral speed of the outlet thereof being 0.5 to 2.0 times the take-up speed of the continuous filament bundles (e.g. 2,000 to 6,000 m/min.), and receiving the continuous filament bundles into a receiving device provided downstream of the bent tube, and an apparatus useful for the take-up of the continuous filament bundles.

13 Claims, 6 Drawing Figures

FIG. 1
PRIOR ART
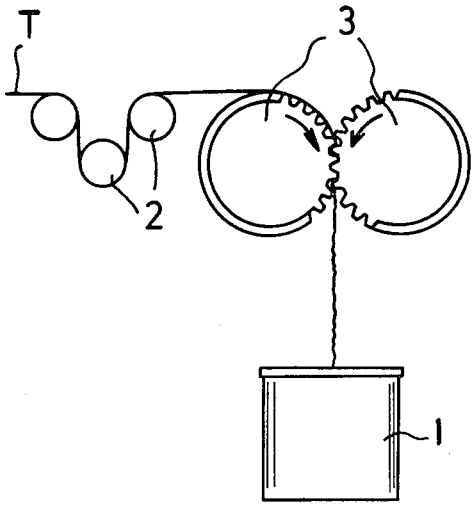
FIG. 2
PRIOR ART
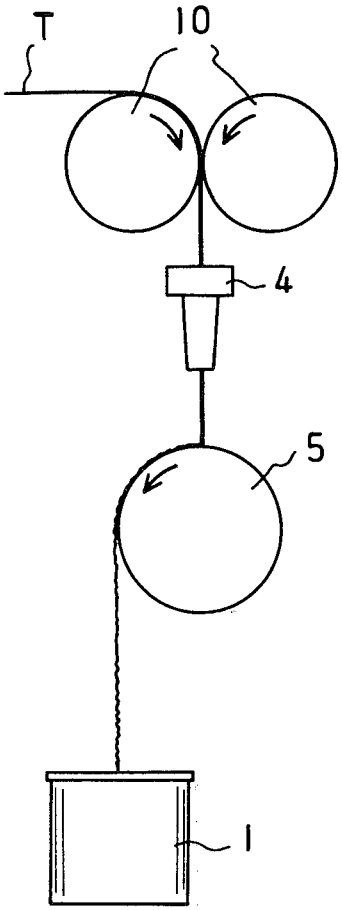
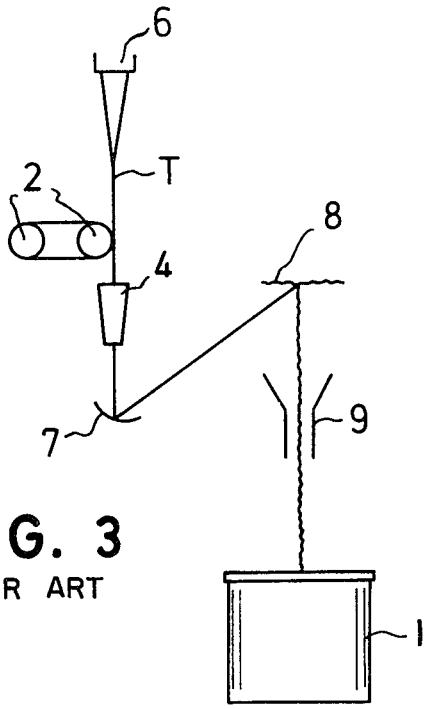
FIG. 3
PRIOR ART

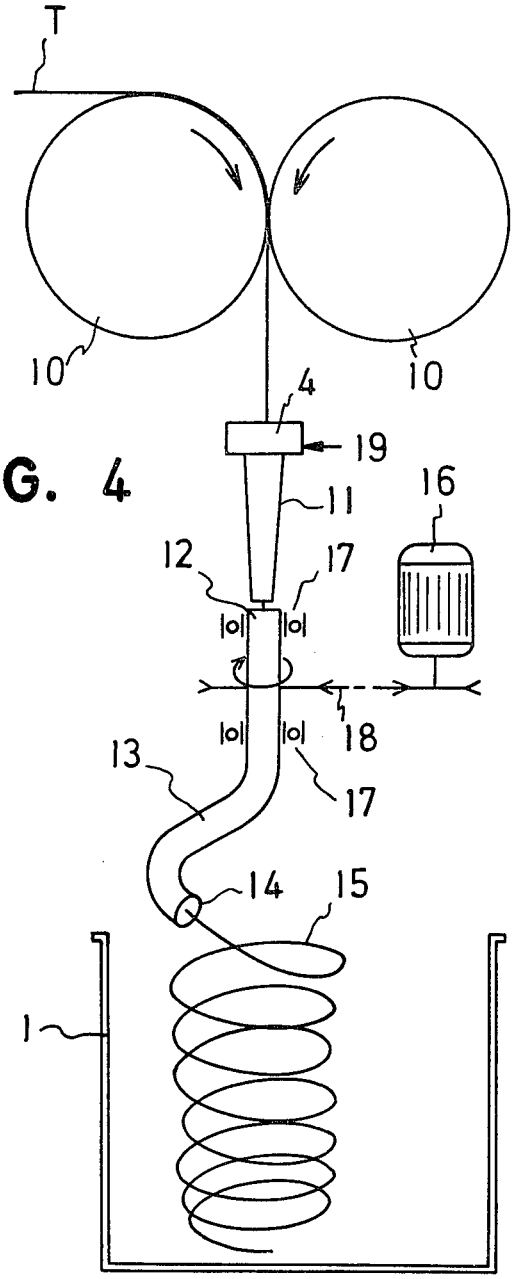
FIG. 4
FIG. 5
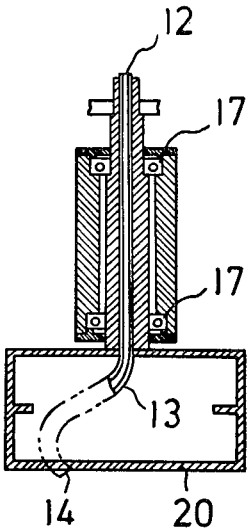
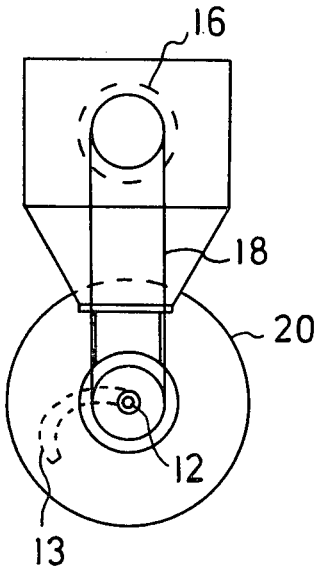
FIG. 6

TAKE-UP METHOD OF CONTINUOUS FILAMENT BUNDLES OF SYNTHETIC FIBERS AND APPARATUS THEREFOR

BACKGROUND AND SUMMARY OF THE INVENTION

The present invention relates to a method and apparatus for the take-up of continuous filament bundles of synthetic fibers at a high speed. More particularly, it relates to a method for the take-up of continuous filament bundles of synthetic fibers, such as yarns and tows, or the like at a high speed, comprising introducing the continuous filament bundles carried on the air stream into a bent tube provided downstream of the air jetting device, which is rotating in substantially reverse direction to that of the continuous filament bundles discharged from the outlet of the bent tube at a peripheral speed of the outlet thereof being 0.5 to 2.0 times the take-up speed of the continuous filament bundles, and receiving the continuous filament bundles into a receiving device, and an apparatus therefor.

Hitherto, the take-up of a number of yarns (e.g. tow) has been carried out by using a pair of gear rollers or a pair of belts, between which the tow is put and taken up. With the speed up in the treatment of the tow for improving the productivity and for rationalizing the procedure, it is required to take up the tow at a higher speed. For instance, when the tow is taken up at a high speed of 2,000 m/min. or more, the conventional methods using gear rollers or belts have a defect that the tow is wound around the final take-up rollers due to the accompanying air stream. For eliminating the defect, it has been proposed to provide an air jetting device in the high speed take-up method. However, when the tow discharged from the air jetting device is directly received into the tow receiving device, the received tow is disturbed by the air stream jetted out together with the tow, and thereby, when the tow is drawn out from the receiving device in the subsequent step, the tow becomes entangled and can not stably be drawn out. There has also been proposed a method comprising striking the tow discharged from the air jetting device onto a lattice or net drum, by which the tow is separated from the air stream, and then the tow is taken up. However, according to this method, when the tow is struck, it is somewhat crimped and entangled, and therefore, when the tow is drawn out from the receiving device in the subsequent step, the tow can not stably be drawn out because it has become snarled.

Under the circumstances, the present inventors have intensively attempted to eliminate these defects in the conventional methods for taking up the continuous filament bundles. As the results, it has been found that the object can be accomplished by using a bent tube which is rotating in a substantially reverse direction to that of the continuous filament bundles discharged from the outlet of the bent tube at a fixed speed.

An object of the present invention is to provide an improved take-up method of the continuous filament bundles of synthetic fibers at a high speed.

Another object of the invention is to provide an apparatus useful for the take-up of the continuous filament bundles of synthetic fibers at a high speed.

These and other objects will be apparent from the following description.

The take-up method of the continuous filament bundles of synthetic fibers (hereinafter, referred to merely as "yarns") of the present invention comprises introducing the yarns discharged from the air jetting device and carried on the air stream into a bent tube provided downstream from the air jetting device, which is rotating in substantially reverse direction to that of the yarns discharged from the outlet of the bent tube at a peripheral speed of the outlet thereof being 0.5 to 2.0 times the take-up speed of the yarns, and receiving the yarns into the receiving device provided downstream from the bent tube.

The apparatus useful for the take-up of yarns at a high speed according to the present invention comprises an air jetting device provided downstream from the final take-up rollers, a bent tube provided downstream from the air jetting device, and a receiving device provided downstream from the bent tube.

According to the present invention, the winding of the yarns onto the final take-up rollers can be prevented by using the air jetting device, and further, by introducing the yarns discharged from the air jetting device into the bent tube together with the jetting air stream and moving the tip of the bent tube circularly in substantially a reverse direction to that of the stream of the yarns and the air, at a speed approximately equal to the take-up speed of the yarns, the yarns and the jetting air are discharged from the outlet of the bent tube at an absolute speed of approximately zero. Therefore the yarns are stably, without any disturbance, disposed into the receiving device.

The present invention will be more clearly understood from the following description referring to the accompanying drawings.

In the drawings, FIGS. 1, 2 and 3 show the conventional apparatus for take-up of yarns. FIG. 1 is a front view of a conventional take-up apparatus using gear rollers. The yarns T are hauled by the traction roller 2, passed through the gear rollers 3 and received into the yarn receiving device 1. When the yarns are taken up at a high speed (e.g. 2,000 m/min. or more) by this method, the yarns T are wound around the gear rollers 3 due to the accompanying air stream which occurs around the gear rollers 3, and thus cannot be stably taken up. For eliminating this defect, it has been proposed to use an air jetting device. In the method using the air jetting device, when the yarns discharged from the outlet of the air jetting device are received into the receiving device together with the jetting air, the received yarns are disturbed by the air stream and thus the yarns become entangled and cannot stably be drawn out in a subsequent step. For eliminating this defect, there have been proposed various methods as shown in the following FIGS. 2 and 3.

FIG. 2 is a front view of a conventional take-up apparatus using a lattice or net drum. In FIG. 2, the yarns T taken up from the traction rollers 10 with the air jetting device 4 are projected onto the lattice or net drum 5, whereby the yarns T are separated from the air stream, and only the yarns T are received into the receiving device 1. However, this method also has defects in that when the yarns are projected onto the drum, the yarns become somewhat crimped and entangled, and therefore, when the yarns are drawn out from the receiving device in a subsequent step, the yarns can not stably be drawn out because they have become snarled. Furthermore, the received yarns have a small bulk density which requires the employment of a larger receiving device.

FIG. 3 is a front view of a conventional take-up apparatus using an air jetting device and a baffle plate wherein the yarns are separated from the air stream by moving the yarns in a reverse direction. In FIG. 3, the yarns T discharged from the nozzle 6 of a melt spinning machine are hauled with the traction rollers 2, wherein the winding of the yarns onto the traction rollers 2 is prevented with the air jetting device 4, and the yarns T discharged from the air jetting device 4 are projected onto the baffle plate 7, are moved in a reverse direction and are received into the receiving device 1, wherein the air stream separator 8 and the shoot 9 are employed. This method is described, for instance, in Japanese patent publication No. 1287/1966. According to this method, for preventing the entanglement and disturbance of the yarns due to the jetting air stream discharged from the air jetting device together with the yarns, the high speed stream of the mixture of the yarns and the jetting air is projected onto the baffle plate 7 provided obliquely to the stream direction of the yarns and air and thereby moved in the reverse direction. Thereafter the yarns fall by their own weight, separating the yarns from the air stream. However, according to this method, when the multifilament yarns are projected onto the baffle plate, the adjacent yarns interfere with each other and therefore the disturbance of the yarns cannot sufficiently be prevented. Moreover, when the yarns are thick, such as tow, the reverse motion of the tow is very difficult.

According to the present invention, the defects in these conventional methods can be eliminated. FIG. 4 is a schematic front view for illustrating the whole apparatus of the present invention. In FIG. 4, the final take-up rollers 10 for taking up the yarns is rotated at a speed similar to the yarn take-up speed, for instance at 2,000 m/min. As the final take-up rollers, a single roller may be employed, or a pair of rollers as shown in FIG. 4 may be employed for decreasing the amount of the air supplied in the air jetting device. In the air jetting device 4, air is introduced under pressure from the inlet 19 and the yarns T are drawn down together with the jetting air stream and thereby the winding of the yarns onto the rollers 10 is prevented. The yarns T and the air stream discharged from the outlet of the air jetting device 4 are led into the inlet 12 of the bent tube 13 with the guide pipe 11. In the bent tube 13, the yarns T and the air stream led into the inlet 12 are passed through the bent tube 13 without a decrease of the flow speed, and then are discharged from the outlet 14 of the bent tube, during which the bent tube 13 is by the driving motor in substantially reverse direction to that of the yarns T and the air stream discharged from the outlet 14 of the bent tube at a peripheral speed of the outlet 14 of 0.5 to 2.0 times, preferably 0.8 to 1.3 times that of the yarn take-up speed. By this operation, the yarns T and the air stream are discharged from the outlet 14 of the bent tube 13 at an absolute speed of approximately zero (relative to the surface of the earth). Accordingly, the yarns T are not disturbed by the air stream and thus fall in a stable, coil form 15. The yarns which fall in the coil form are received in the yarn receiving device 1 without any entanglement of the yarns in a state of high bulk density. More preferably, the receiving device 1 is rotated or reciprocated while receiving the yarns.

When the rotating speed of the outlet 14 of the bent tube 13 is over 2.0 times the yarn take-up speed, the yarns T passed through the bent tube 13 are pulled with the bent tube 13, and thereby, the received yarns are moved in the receiving device 1, which causes the entanglement of the yarns. On the other hand, when the rotating speed of the outlet 14 is less than 0.5 times that the yarn take-up speed, the yarns and the air stream have a fairly large absolute speed and the yarns are disturbed while the speed is decreased with the air resistance, and therefore, the received yarns have a small bulk density, which requires the employment of a larger receiving device. The yarn take-up speed is preferably 2,000 m/min. or more, and is usually from 2,000 to 6,000 m/min.

FIGS. 5 and 6 show one embodiment of the device for driving the bent tube, and FIG. 5 is a sectional front view thereof and FIG. 6 is a plane view thereof. The bent tube 13 is supported with the bearing 17 and is rotated with the motor 16 via the belt 18. The bent tube is bent in the radial direction toward the tip thereof and in the tangential direction, and the outlet 14 is opened in the tangential direction. Besides, it is preferable that the outlet 14 is opened in an angle of about ± 50° against the horizontal direction, and is more preferably opened downward in an angle of 15° to 45° against the horizontal direction. The bent tube is preferably made of steel or porcelain and has a smooth inner surface. Moreover, the bent tube is preferably connected in one piece with the cylindrical cover 20 at the bent section of the bent tube. Said cylindrical cover 20 functions as the balance weight and is useful for inhibiting the rotating air stream.

The present invention is illustrated by the following Example, but is not limited thereto.

EXAMPLE 1

Polyethylene terephthalate having an intrinsic viscosity of 0.63 (measured in a mixed solvent of phenol/tetrachloroethane = 6/4, at 30° C) is melt-spun through a spinneret (number of holes: 2,000), and the spun filaments are cooled and solidified by blowing them air stream at room temperature at just below the spinneret. The filaments are treated with an oiling agent and then taken up with the first rollers at a speed of 3,200 m/min. and led to the bundling rollers, during which the moving direction of the filaments is controlled. Eight filaments thus obtained by the high speed spinning are bundled, and the yarns thus produced are led to the final take-up rollers which are rotating at a peripheral speed of 3,200 m/min. The yarns are passed through the air jetting device and the rotating bent tube and then received in the cylindrical can, as shown in FIG. 4. The outlet of the bent tube used therein is opened downward in an angle of 25° against the horizontal direction, and the rotating radius is 15 cm and the peripheral speed of the outlet is 3,500 m/min. The can is rotated by the supporting rotating circular plate so that the yarns are uniformly received in the spiral form in the can.

The received yarns are tightly packed in the can (the bulk density: 200 kg/m$^3$), and when the yarns are drawn out for the orientation thereof in the subsequent step, the snarl of the yarns is observed only one time per 100,000 m.

For the comparison purpose, according to the conventional methods as shown in FIGS. 1 and 2, the same yarns as used in the above Example 1 are received in the receiving can at a take-up speed of 3,200 m/min. As the results, in case of using the gear rollers as shown in FIG. 1, the yarns are frequently wound onto the gear rollers and it is impossible to continue the operation. Besides, in case of the method as shown in FIG. 2, the yarns are loosely packed in the can (the bulk density: 70 kg/m$^3$), and when the yarns are drawn out for the orientation thereof in the subsequent step, the snarl of the yarns is frequetly observed, i.e. one time per 1,000 m, which is remarkedly inferior to the method of the present invention.

What is claimed is:

1. A method for the take-up of continuous filament bundles of synthetic fibers at a high speed, which comprises introducing the continuous filament bundles discharged from an air jetting device and carried on the air stream into a bent tube provided downstream from the air jetting device, said bent tube being bent in the radial direction toward the tip thereof and in the tangential direction and the outlet thereof is opened in the tangential direction, said bent tube rotating in substantially a reverse direction to that of the continuous filament bundles discharged from the outlet of the bent tube, with the peripheral speed of the outlet being 0.5 to 2.0 times the take-up speed of the continuous filament bundles, and receiving the continuous filament bundles into a receiving device provided downstream from the bent tube.

2. The method according to claim 1, wherein the take-up speed of the continuous filament bundles is 2,000 m/min. or more.

3. The method according to the claim 2, wherein the take-up speed of the continuous filament bundles is 2,000 to 6,000 m/min.

4. The method according to the claim 1, wherein the peripheral speed of the outlet of the bent tube is 0.8 to 1.3 times the take-up speed of the continuous filament bundles.

5. The method according to claim 1, wherein the outlet of the bent tube is opened at an angle of about ± 50° relative to the horizontal direction.

6. The method according to claim 5, wherein the outlet of the bent tube is opened downward at an angle of 15° to 45° relative to the horizontal direction.

7. The method according to claim 1, wherein the bent tube is connected in one piece with a cylindrical cover disposed at the bent section thereof.

8. The method according to claim 1, wherein the receiving device is a can.

9. An apparatus for the take-up of continuous filament bundles of synthetic fibers at a high speed, comprising final take-up rollers, an air jetting device provided downstream of the final take-up rollers, a bent tube provided downstream of the air jetting device, the outlet of the bent tube being opened downward in an angle of 15° to 45° relative to the horizontal direction, and a receiving device provided downstream of the bent tube, said bent tube rotating in substantially a reverse direction to that of the continuous filament bundles discharged from the outlet of the bent tube with the peripheral speed of the outlet being 0.5 to 2.0 times the take-up speed of the continuous filament bundles.

10. The apparatus according to claim 9, wherein the outlet of the bent tube is opened in an angle of about ± 50° relative to the horizontal direction.

11. The apparatus according to claim 10, wherein the outlet of the bent tube is opened downward in an angle of 15° to 45° relative to the horizontal direction.

12. The apparatus according to claim 9, wherein the bent tube is connected in one piece with a cylindrical cover at the bent section thereof.

13. The apparatus according to claim 9, wherein the receiving device is a can.

* * * * *